US005707021A

United States Patent [19]

Bitts et al.

[11] Patent Number: 5,707,021

[45] Date of Patent: Jan. 13, 1998

[54] CONE AND RIBBON HOLDING DEVICE

[76] Inventors: Wyatt E. Bitts; Kathleen M. Watson, both of 25 Circle Dr., Oxford, Pa. 19363

[21] Appl. No.: 656,806

[22] Filed: Sep. 5, 1996

[51] Int. Cl.[6] ..... B65H 49/18; B65H 57/00; A41H 31/00

[52] U.S. Cl. ..... 242/139; 112/302; 112/152; 223/106; 242/140

[58] Field of Search ..... 242/140, 137.1, 242/139, 130.4, 131, 128, 597.5, 129; 112/302, 370.31, 152; 223/106

[56] References Cited

U.S. PATENT DOCUMENTS

| | | | |
|---|---|---|---|
| 490,096 | 1/1893 | Bates | 242/139 |
| 1,395,155 | 10/1921 | Smith | 223/106 |
| 1,580,687 | 4/1926 | Selbst | 242/139 |
| 2,508,887 | 5/1950 | Orrigo | 112/302 X |
| 2,610,599 | 9/1952 | Picciano et al. | 242/139 X |
| 3,282,236 | 11/1966 | Wardlaw | 242/140 X |
| 3,690,584 | 9/1972 | Wilkerson | 242/128 |
| 5,315,946 | 5/1994 | Howell et al. | 112/152 X |

*Primary Examiner*—Michael Mansen

[57] ABSTRACT

A cone and ribbon holding device including a base portion. A pair of cone holders are secured to the base portion. A pair of thread guides are secured to the base portion. The pair of thread guides are positioned intermediate the pair of cone holders. A ribbon guide is secured to the base portion adjacent to an end portion thereof. The ribbon guide is adapted for receipt of a roll of ribbon thereon.

1 Claim, 2 Drawing Sheets

CONE AND RIBBON HOLDING DEVICE

BACKGROUND OF THE INVENTION

1. Field of the Invention

The present invention relates to a cone and ribbon holding device and more particularly pertains to converting a standard sewing machine to use cone overlock thread fed directly into a sewing machine with a cone and ribbon holding device.

2. Description of the Prior Art

The use of thread holders is known in the prior art. More specifically, thread holders heretofore devised and utilized for the purpose of holding thread for sewing machines are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,023,512 to Miyamoto discloses a thread feeder for sewing machine.

U.S. Pat. No. 4,407,461 to Tomisawa discloses a spool holding device.

U.S. Pat. No. Des. 331,244 to Jensen discloses the ornamental design for a ribbon and yarn spool holder.

U.S. Pat. No. Des. 275,593 to Carter discloses the ornamental design for a combined fly tying bobbin holder and thread guide.

U.S. Pat. No. Des. 345,857 to Franke discloses the ornamental design for a spool holder.

U.S. Pat. No. 4,328,758 to Souza et al. discloses a thread end holder for sewing machine.

U.S. Pat. No. 4,590,879 to Matsubara et al. discloses a thread feed device in a sewing machine.

While these devices fulfill their respective, particular objective and requirements, the aforementioned patents do not describe a cone and ribbon holding device for holding thread and ribbon to be fed into a sewing machine.

In this respect, the cone and ribbon holding device according to the present invention substantially departs from the conventional concepts and designs of the prior art, and in doing so provides an apparatus primarily developed for the purpose of converting a standard sewing machine to sew with cone overlock thread.

Therefore, it can be appreciated that there exists a continuing need for new and improved cone and ribbon holding device which can be used for holding thread and ribbon to be fed into a sewing machine. In this regard, the present invention substantially fulfills this need.

SUMMARY OF THE INVENTION

In the view of the foregoing disadvantages inherent in the known types of thread holders now present in the prior art, the present invention provides an improved cone and ribbon holding device. As such, the general purpose of the present invention, which will be described subsequently in greater detail, is to provide a new and improved cone and ribbon holding device that converts a standard sewing machine to sew with cone overlock thread and method which has all the advantages of the prior art and none of the disadvantages.

To attain this, the present invention essentially comprises a base portion having a generally rectangular configuration. The base portion has a planar upper surface and a planar lower surface. The device includes a pair of cone holders each having lower end portions secured to the planar upper surface of the base portion. Upper end portions of the pair of cone holders each have a rounded knob portion integral therewith. The pair of cone holders are adapted for receipt of cone-shaped thread spools thereon. The device includes a pair of thread guides each having lower portions with distal ends secured to the planar upper surface of the base portion. The pair of thread guides are positioned intermediate the pair of cone holders. Each upper portion has an eyelet disposed on an upper end thereof. The device includes a ribbon guide comprised of a shaft having a lower end secured to the planar upper surface of the base portion adjacent to an end portion thereof. The shaft is adapted for receipt of a roll of ribbon thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cone and ribbon holding device which has all the advantages of the prior art thread holders and none of the disadvantages.

It is another object of the present invention to provide a new and improved cone and ribbon holding device which may be easily and efficiently manufactured and marketed.

It is a further object of the present invention to provide a new and improved cone and ribbon holding device which is of durable and reliable construction.

An even further object of the present invention is to provide a new and improved cone and ribbon holding device which is susceptible of a low cost of manufacture with regard to both materials and labor, and which accordingly is then susceptible of low prices of sale to the consuming public, thereby making such a cone and ribbon holding device economically available to the buying public.

Still yet another object of the present invention is to provide a new and improved cone and ribbon holding device which provides in the apparatuses and methods of the prior art some of the advantages thereof, while simultaneously overcoming some of the disadvantages normally associated therewith.

Even still another object of the present invention is to provide a new and improved cone and ribbon holding device for holding thread and ribbon to be fed into a standard sewing machine. Thus, converting a standard sewing machine to use cone overlock thread.

Lastly, it is an object of the present invention to provide a new and improved cone and ribbon holding device including a base portion. A pair of cone holders are secured to the base portion. A pair of thread guides are secured to the base portion. The pair of thread guides are positioned intermediate the pair of cone holders. A ribbon guide is secured to the base portion adjacent to an end portion thereof. The ribbon guide is adapted for receipt of a roll of ribbon thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various FIGS.

DESCRIPTION OF THE PREFERRED EMBODIMENT

Figure 2:
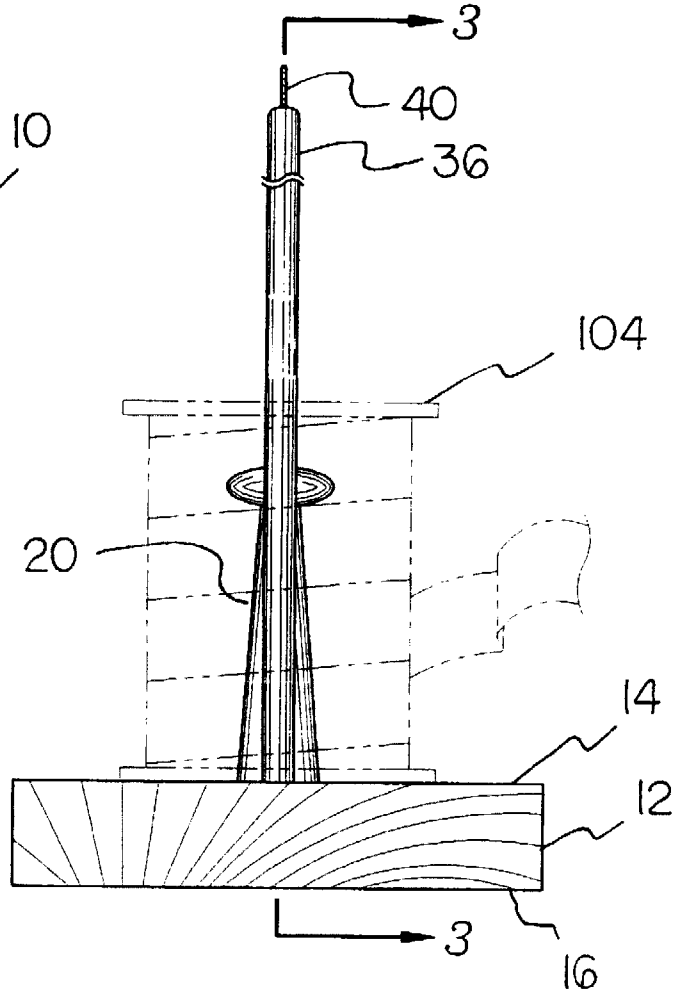
FIG. 2 is a side elevation view of the present invention.
Figure 1:
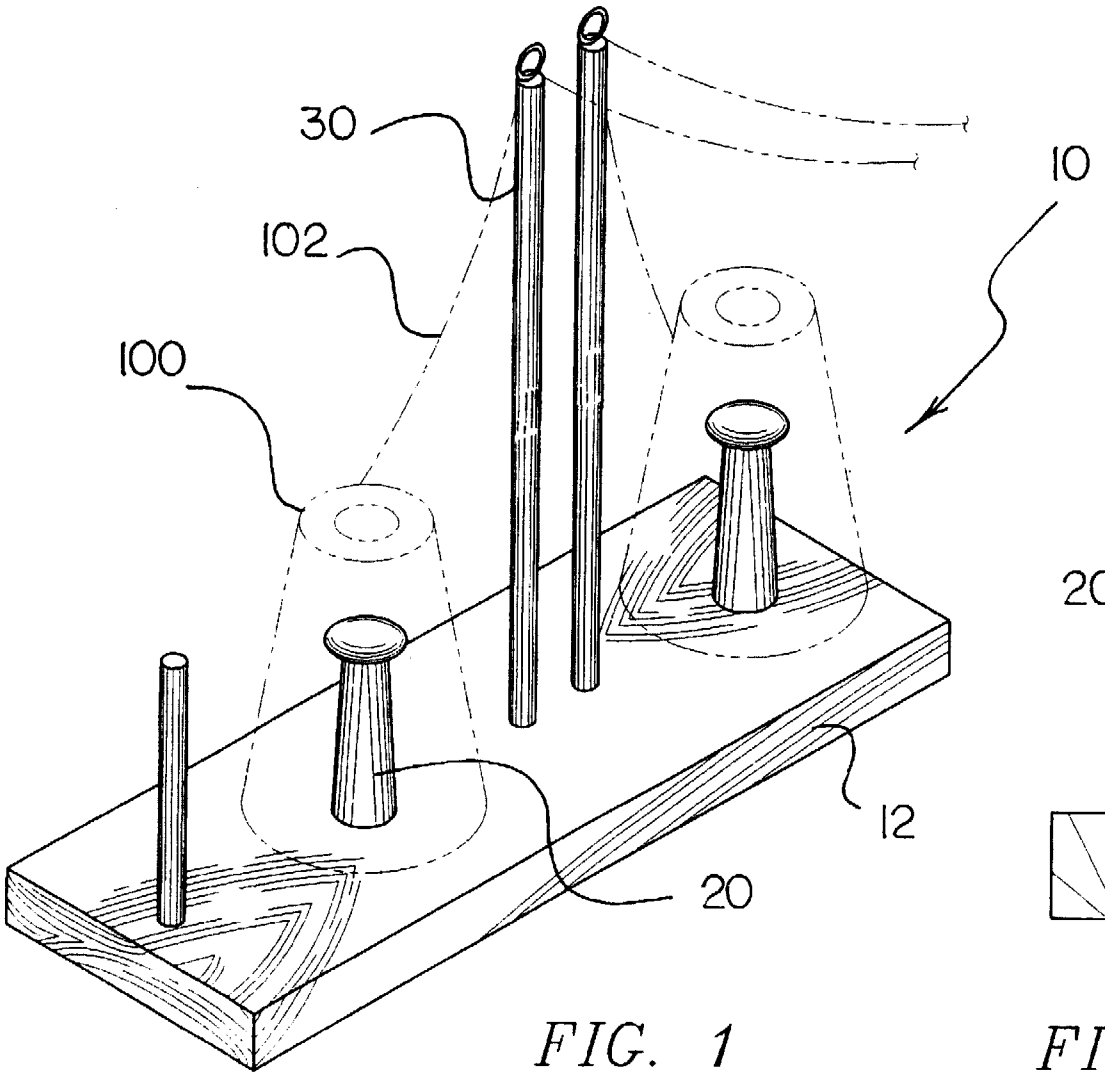
FIG. 1 is a perspective view of the preferred embodiment of the cone and ribbon holding device constructed in accordance with the principles of the present invention.
Figure 3:
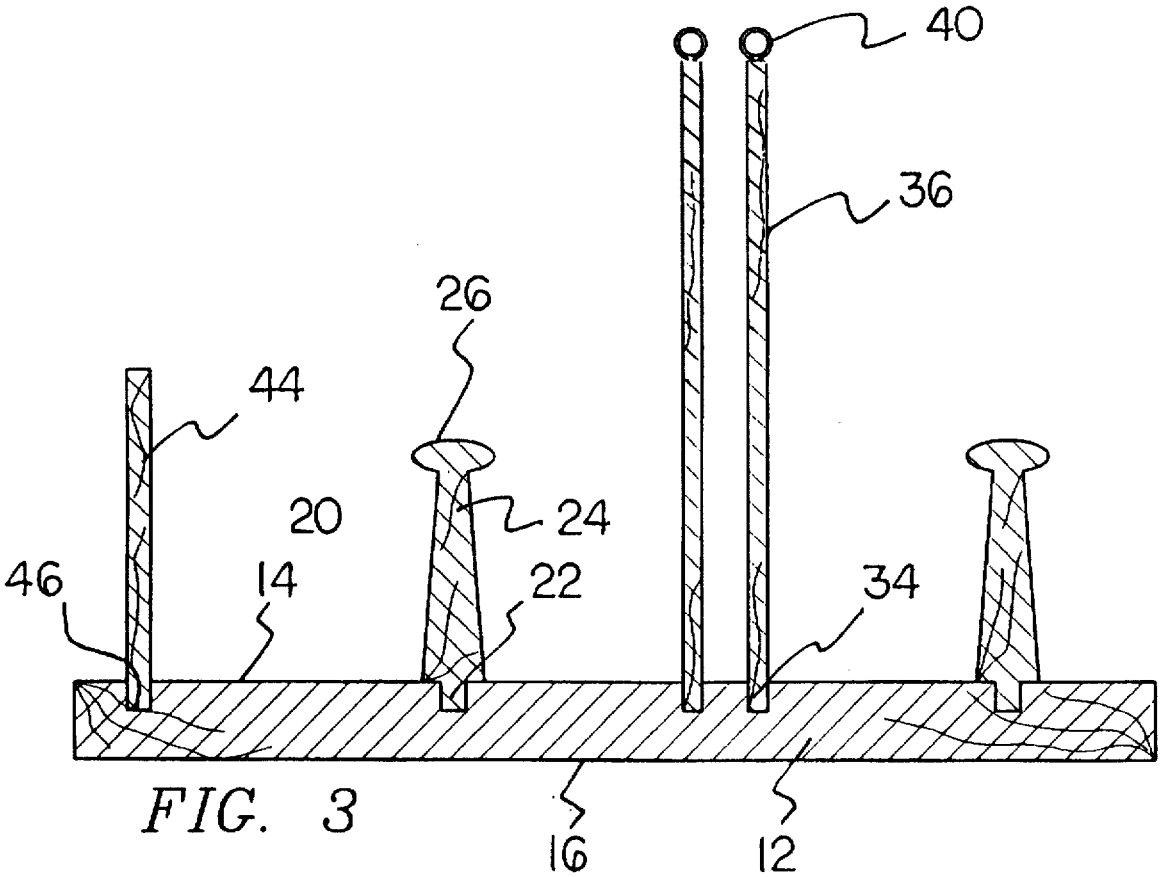
FIG. 3 is a cross-sectional view as taken along line 3—3 of FIG. 2.
Figure 4:
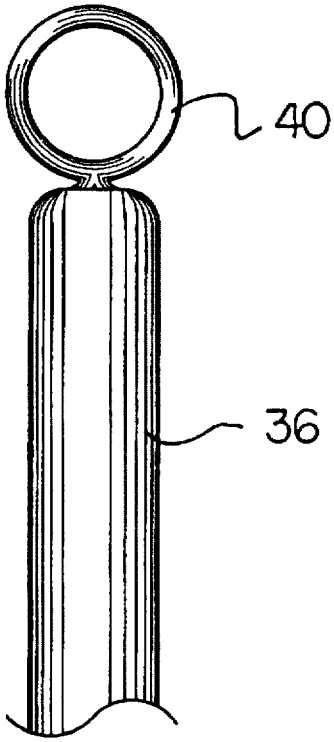
FIG. 4 is a fragmentary front view of one of the thread guides of the present invention.

With reference now to the drawings, and in particular, to FIGS. 1–4 thereof, the preferred embodiment of the new and improved cone and ribbon holding device embodying the principles and concepts of the present invention and generally designated by the reference number 10 will be described.

Specifically, it will be noted in the various Figures that the device relates to a new and improved cone and ribbon holding device for holding thread and ribbon to be fed into a standard sewing machine. In its broadest context, the device consists of a base portion, a pair of cone holders, a pair of thread guides, and a ribbon guide. Such components are individually configured and correlated with respect to each other so as to attain the desired objective.

The device 10 includes a base portion 12 having a generally rectangular configuration. The preferable construction of the base portion 12 is of wood material. The base portion 12 has a planar upper surface 14 and a planar lower surface 16.

The device 10 also includes a pair of cone holders 20 each having lower end portions 22 secured to the planar upper surface 14 of the base portion 12. Upper end portions 24 of the pair of cone holders 20 each have a rounded knob portion 26 integral therewith. The pair of cone holders 20 are adapted for receipt of cone-shaped thread spools 100 thereon. The thread spools 100 are placed on the cone holders 20 and are able to freely rotate. The thread spools 100 are placed on the cone holders 20. The rounded knob portion 26 holds the thread in a fixed position.

Next, the device 10 includes a pair of thread guides 30 each having lower portions with distal ends 34 secured to the planar upper surface 14 of the base portion 12. The pair of thread guides 30 are positioned intermediate the pair of cone holders 20. Each of the pair of thread guides 30 have an upper portion each having an eyelet 40 disposed on an upper end thereof. The height of the thread guides 30 are set to a height equal to the height of a sewing machine. Thread 102 from the cone-shaped thread spools 100 is extended up and through the eyelets 40 to be threaded into the sewing machine. This device 10 is especially useful on sewing machines that have double needles whereby both thread spools 100 positioned on the pair of cone holders can be utilized.

Lastly, the device 10 includes a ribbon guide comprised of a shaft 44 having a lower end 46 secured to the planar upper surface 14 of the base portion 12 adjacent to an end portion thereof. The shaft 44 is adapted for receipt of a roll of ribbon 104 thereon. The shaft 44 serves to hold the roll of ribbon 104 at a position readily available to be used by the user. This device 10 is useful in that cone-shaped thread spools 100 have become more available to the public for use in place of the smaller spools of thread. The cone-shaped thread spools 100 are more economical than the smaller spools of thread.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cone and ribbon holding device for holding thread and ribbon to be fed into a standard sewing machine comprising, in combination:

a base portion having a generally rectangular configuration, the base portion having a planar upper surface and a planar lower surface;

a pair of cone holders each having lower end portions secured to the planar upper surface of the base portion, upper end portions of the pair of cone holders each having a rounded knob portion integral therewith, the pair of cone holders being adapted for receipt of cone-shaped thread spools thereon;

a pair of thread guides each having lower portions with distal ends secured to the planar upper surface of the base portion, the pair of thread guides positioned intermediate the pair of cone holders, each of the pair of thread guides having an upper portion extending upwardly from the lower portions, each upper portion having an eyelet disposed on an upper end thereof and extending upwardly therefrom;

a ribbon guide comprised of a shaft having a lower end secured to the planar upper surface of the base portion adjacent to an end portion thereof, the shaft being adapted for receipt of a roll of ribbon thereon;

a pair of cone-shaped spools having thread disposed therein, the spools dimensioned for coupling with the pair of cone holders, the thread extending upwardly through the eyelets for extending above the device;

a roll of ribbon dimensioned for coupling with the shaft of the ribbon guide.

* * * * *